US005799233A

United States Patent [19]

Ishii et al.

[11] Patent Number: 5,799,233

[45] Date of Patent: Aug. 25, 1998

[54] CHARGING APPARATUS AND IMAGE FORMING APPARATUS

[75] Inventors: Yasuyuki Ishii, Mishima; Hiroyuki Adachi, Shizuoka-ken; Hiroki Kisu, Fujisawa; Hiroaki Ogata, Shizuoka-ken, all of Japan

[73] Assignee: Canon Kabushiki Kaisha, Tokyo, Japan

[21] Appl. No.: 710,998

[22] Filed: Sep. 26, 1996

[30] Foreign Application Priority Data

Sep. 26, 1995 [JP] Japan ..... 7-273516

[51] Int. Cl.[6] ..... G03G 15/02

[52] U.S. Cl. ..... 399/175; 399/174; 361/225

[58] Field of Search ..... 399/174, 175; 361/214, 225, 230

[56] References Cited

U.S. PATENT DOCUMENTS

| | | | |
|---|---|---|---|
| Re. 35,214 | 4/1996 | McGarry et al. | 361/214 |
| 5,351,109 | 9/1994 | Haneda | 399/175 |
| 5,357,323 | 10/1994 | Haneda et al. | 399/175 |
| 5,426,489 | 6/1995 | Haneda et al. | 399/175 |
| 5,457,522 | 10/1995 | Haneda et al. | 399/176 |
| 5,579,095 | 11/1996 | Yano et al. | 399/175 |
| 5,592,264 | 1/1997 | Shigeta et al. | 399/175 |
| 5,596,394 | 1/1997 | Nishiguchi et al. | 399/175 |
| 5,606,401 | 2/1997 | Yano | 399/175 |

FOREIGN PATENT DOCUMENTS

| | | |
|---|---|---|
| 63-149669 | 6/1988 | Japan . |
| 06003921 | 1/1994 | Japan . |
| 07005748 | 1/1995 | Japan . |

*Primary Examiner*—Matthews S. Smith

*Attorney, Agent, or Firm*—Fitzpatrick, Cella, Harper & Scinto

[57] ABSTRACT

A charging apparatus includes a charging member contactable or proximatable to a member to be charged, the charging member being capable of being supplied with a voltage; wherein the charging member has a magnetic particle layer, and a magnetic force generator with a gap for generating magnetic force in the magnetic particles, the magnetic particle layer and magnetic force generator forming a magnetic circuit; and wherein the magnetic particle has a particle size of no less than 10 μm and no more than 100 μm, and the maximum magnetic flux density in the gap ranges $1,000\times10^{-4}$ T–$10,000\times10^{-4}$ T.

12 Claims, 13 Drawing Sheets

A : MAGNETITE
B : COPPER-ZINC FERRITE
C : OXIDE

CHARGING APPARATUS AND IMAGE FORMING APPARATUS

FIELD OF THE INVENTION AND RELATED ART

The present invention relates to a charging apparatus and an image forming apparatus, which comprise a charging member having a magnetic particle layer for charging an object.

In the past, a corona type charging device was employed as means for charging (inclusive of discharging) an image bearing member such as a photosensitive member, a dielectric member, or the like, of an image forming apparatus such as an electrophotographic apparatus (copying machine, laser beam printer, and the like) or an electrostatic recording apparatus.

In recent years, a contact type charging apparatus has been put to practical use, replacing the corona type charging device. In the case of the contact type charging apparatus, a member to which voltage is applied is placed in contact with an object to be charged, so that the surface to be charged is charged through electric discharge. The employment of the contact type charging device is intended for reducing ozone production and electricity consumption. Among various contact type charging systems on which the contact type charging is based, a roller type system employing an electrically conductive roller as the charging member is particularly preferable in terms of reliability, and therefore, is widely in use.

In the case of the roller type charging system, in order to charge an object, an electrically conductive elastic roller (charge roller) is placed in contact with an object to be charged, with application of a predetermined contact pressure, and then, voltage is applied to the charging roller.

More specifically, an object is charged through electric discharge from the charging member to the object to be charged. Therefore, charging of the object begins when the voltage applied to the charging member exceeds a threshold voltage. For example, when a charge roller is placed in contact with a photosensitive member comprising a 25 μm thick layer of OPC, the surface potential of the photosensitive member begins to rise as an approximate voltage of no less than 640 V is applied to the charge roller. Above this threshold voltage, the surface potential of the photosensitive member linearly increases in proportion to the applied voltage. Hereinafter, this threshold voltage is referred to as charge start voltage $V_{th}$.

In other words, in order to give the photosensitive member a surface potential of $V_d$, that is, a surface potential necessary for electrophotography, a DC voltage of $(V_d+V_{th})$, which exceeds the necessary surface potential for the photosensitive member, must be applied to the charge roller. This method of applying only a DC voltage to the charging member in order to charge the object to be charged is called "DC charge system".

Japanese Laid Open Patent Application No. 149,669/1988 discloses another charging system called "AC charge system". According to this system, a superposed voltage composed by superposing an AC voltage having a peak-to-peak voltage of no less than $2\times V_{th}$ on a DC voltage equivalent to the desired $V_d$ is applied to the charging member so that the object is more uniformly charged than by the DC charge system. This system is intended for taking advantage of the averaging effect of the AC component, wherein the potential of the charged object converges to the voltage $V_d$ which coincides with the center voltage between the top and bottom peaks of the AC voltage, and therefore, this system is not affected by external disturbance such as environmental disturbance.

It should be noted here that the charging member is not necessarily required to be placed in contact with the surface to be charged; the charging member does not need to be in contact with the surface to be charged, as long as the gap between the two satisfies the electric discharge causing condition, which is dependent on the voltage across the gap between the charging member and the surface to be charged, and adjusted Paschen curve.

Laid Open Patent Nos. 3,921/1994, 5,748/1995, or the like disclose a novel contact type charging system, in which electric charge is directly injected into the object to be charged. More specifically, electric charge is directly injected into the electrically conductive particles of a charge injection layer provided on the surface of the object to be charged, by applying voltage to the contact type charging member. Hereinafter, this charging system is called "charge injection system".

Since this charge injection system does not need electric discharge, the voltage necessary for charging the photosensitive member has only to be a voltage equivalent to the desired surface potential for the photosensitive member. Therefore, this system does not generate ozone.

In other words, this system is superior to the charging system dependent on electric discharge, since it does not generate ozone, and consumes a lower amount of electricity than the preceding system.

More specifically, there are several methods of this type; for example, a method employing a charge roller, a method employing a charge brush, a method employing a magnetic charge brush, or the like. Among them, the method employing a magnetic brush is deemed to be superior to, and more practical than, the other methods, in consideration of the frequency with which the magnetic particles are placed in contact with the electrically conductive particles of the charge injection layer, that is, the surface layer of the photosensitive drum. In this method, a magnetic brush comprising a magnet roller and the magnetic particles held by the magnet roller is moved in the direction opposite to the moving direction of the surface of the photosensitive member as the object to be charged.

However, when a magnetic brush is employed as the charging member for the contact type charging method or the injection type charging method, the magnetization level of the magnetic particles, and the magnetic flux density of the magnetic roller, which holds the magnetic particles, are weak; the force with which the magnetic brush holds the magnetic particles is weak. Therefore, some of the magnetic particles are transferred onto the surface of the object being charged, due to the charge contrast. In other words, in the case of an image forming apparatus, the magnetic particles are transferred onto the surface of the image bearing member as the object to be charged, causing the surface of the resulting image to be coarse and nonuniform after the image transfer and fixation processes.

Further, the amount of the magnetic particles constituting the magnetic brush is reduced, which reduces the size of the contact nip that contributes to charge the object to be charged. As a result, charge uniformity gradually deteriorates, and also, charging capacity deteriorates. The magnetic particle holding force of a magnetic brush is proportional to the product of the magnetic flux density of the magnet which holds the magnetic particles, and the magnetization level of the magnetic particles. Therefore, in order to increase the magnetic particle holding force of the magnetic brush, it is necessary either to increase the magnetic flux density of the magnet which holds the magnetic particles, or to employ magnetic particles magnetizable to a high level.

Technically, it is possible to produce a roller-shaped magnet having a high level of magnetic flux density, but it costs too much. Also, selecting the highly magnetizable particles limits latitude in selecting the particle diameter, electrical characteristics, and the like, of the magnetic particles.

SUMMARY OF THE INVENTION

Accordingly, a primary object of the present invention is to provide a charging apparatus capable of preventing the magnetic particles from transferring from the charging member to the object to be charged, and adhering to the object to be charged, so that the object to be charged can be uniformly charged.

Another object of the present invention is to provide a charging apparatus capable of maintaining satisfactory contact between the charging member and the object to be charged, while preventing the magnetic particles of the magnetic member from damaging the object to be charged.

Another object of the present invention is to provide a charging apparatus capable of charging the object to be charged, without causing electrical leakage even when the object to be charged has pinholes.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

<Embodiment 1> (FIGS. 1–4)

(A) Image Forming Apparatus

Figure 1:
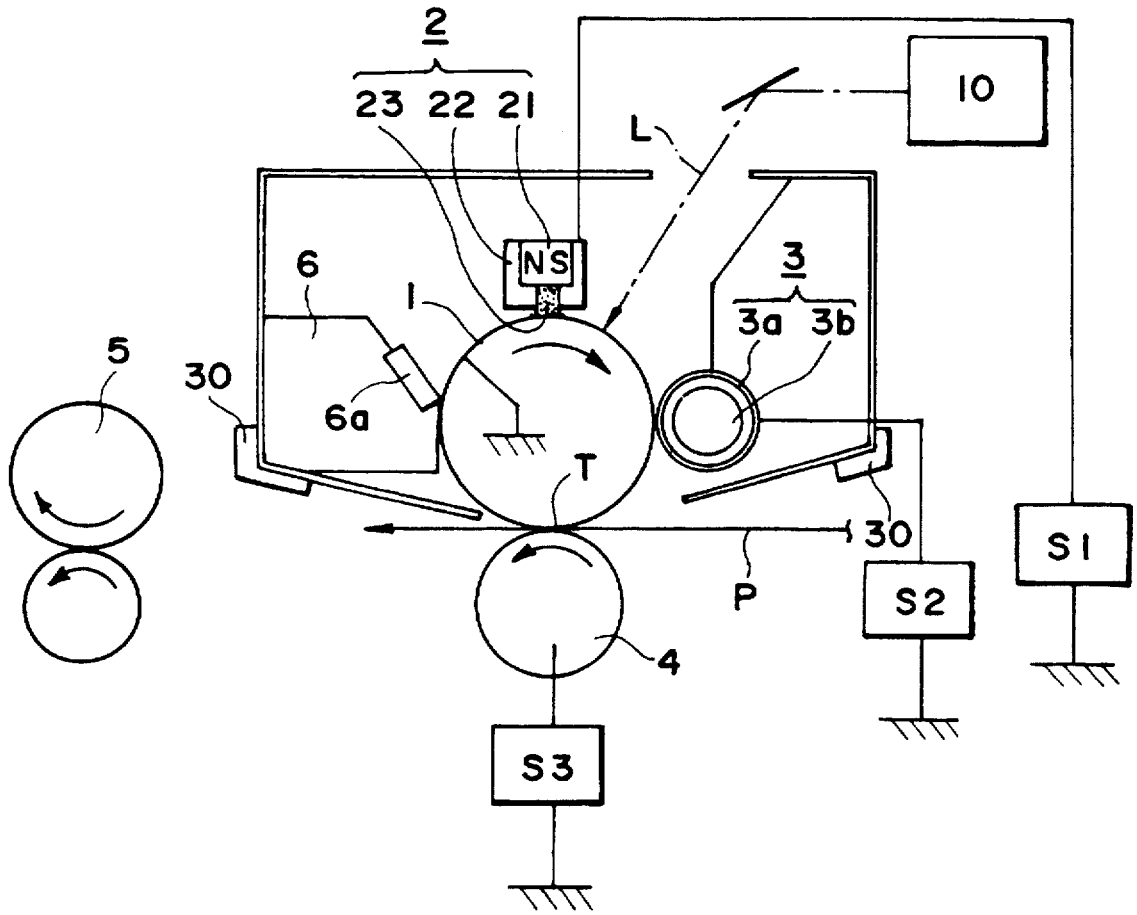
FIG. 1 is a schematic drawing depicting the structure of the image forming apparatus in the first embodiment of the present invention.

FIG. 1 is a schematic drawing depicting the structure of the image forming apparatus in the first embodiment of the present invention. The image forming apparatus in this embodiment is a laser beam printer employing the transfer type electrophotographic process, a contact type charging system, and a replaceable process cartridge.

Reference numeral 1 designates an electrophotographic photosensitive member as an image bearing member, that is, an object to be charged, in the form of a rotary drum. It is rotatively driven in the clockwise direction indicated by an arrow mark, at a process speed (peripheral velocity) of 100 mm/sec.

Reference numeral 2 designates a magnetic brush as the contact type charging member. It comprises a magnet 21, a yoke 22, and magnetic particles 23 held by the magnetic force in the gap of the yoke, and forms a magnetic circuit. The actual brush portion constituted of the magnetic particles 23 is in contact with the surface of the photosensitive member 1. To this magnetic brush 2, a voltage composed by superposing an AC voltage of 1.6 K $V_{pp}$ onto a DC voltage of −600 V is applied from a charge bias application power source $S_1$, so that the peripheral surface of the photosensitive rotary member 1 is substantially uniformly charged to a potential level of −680 V through the contact type charging process based on electric discharge (AC charge system). The frequency of the voltage applied in this case is preferably satisfies the following formula, so that the surface potential nonuniformity is not caused by the frequency of the applied voltage:

$$f\ (\text{frequency of applied voltage})/V_{ps}\ (\text{process speed})>5$$

The charged surface of the photosensitive rotary member 1 is exposed to a scanning exposure light L (laser beam). The scanning exposure light L is modulated in intensity with sequential picture element signals, that is, electric digital signals reflecting the image data of a target image, and is emitted from a laser beam scanner 10 comprising a laser diode, a polygon mirror, and the like. As a result, an electrostatic latent image corresponding to the image data of the target image is formed on the peripheral surface of the photosensitive rotary member 1.

The electrostatic latent image is developed into a toner image with magnetic, insulative, single component toner, using a reversal type developing apparatus 3. Reference 3*a* designates a nonmagnetic development sleeve having a diameter of 16 mm. It encloses a magnet 3*b*. The development sleeve 3*a* is coated with the aforementioned negative toner, and is disposed in such a manner that the distance to the surface of the photosensitive member becomes 300 μm. It is rotated at the same speed as the photosensitive member 1, and a development bias is applied to the sleeve 3*a* from a development bias power source $S_2$ in order to cause the so-called jumping development process to be carried out between the sleeve 3*a* and the photosensitive member 1. The development voltage is a superposed voltage composed of a DC voltage of −500 V, and an AC voltage having a frequency of 1,800 Hz, a peak-to-peak voltage of 1,600 V, and a rectangular waveform.

Meanwhile, a transfer material P as a recording material is delivered with a predetermined timing from an unillustrated sheet feeding section to a pressure nip T (transfer section) formed by the photosensitive rotary member 1 and a medium resistance transfer roller 4, as contact type transferring means, placed in contact with the photosensitive rotary member 1. To the transfer roller 4, a predetermined transfer bias is applied from a transfer bias application power source $S_3$. In this embodiment, the transfer roller employed has a resistance value of $5\times10^8$ Ω, and the voltage applied to the transfer roller 4 for transferring the toner image is a DC voltage of +2,000 V.

While the transfer material P introduced into the transfer section T is passing through the transfer section T, being pinched therein, the toner image formed and borne on the surface of the photosensitive rotary member 1 is transferred onto the photosensitive member facing side of the transfer material P by the electrostatic force and the nip pressure, starting from one edge of the image to the other.

After the transfer of the toner image onto the transfer material P, the transfer material P is separated from the surface of the photosensitive member 1, and is introduced into a fixing apparatus 5 based on a thermal fixation system or the like to fix the toner image to the transfer material P. Thereafter, the transfer material P with the fixed image is discharged as a print or a copy from the apparatus.

After the transfer of the toner image onto the transfer material P, the photosensitive member surface is cleaned; adhesive contaminants such as residual toner are removed by a cleaning blade 6*a* of a cleaning apparatus 6. Thereafter, the photosensitive member is used again for the following image formation.

The image forming apparatus in this embodiment comprises four processing devices, that is, the photosensitive member 1, the contact type charging member 2, the developing apparatus 3, and the cleaning apparatus 6, which are bundled in the form of a process cartridge 20 so that they can be installed into, or removed from, the main assembly of the image forming apparatus all at once. Reference numeral 30 designates a member which guides and holds the process cartridge 20. The combinational selection of the processing devices to be placed in the process cartridge 20 does not need to be limited to the above described one. The process cartridge 20 has only to comprise the photosensitive member 1, and at least one processing device among the charging member 2, the developing apparatus 3, and the cleaning apparatus 6.

(B) Charging Member 2

The magnetic brush as the contact type charging member comprises a magnet 21, a magnetism permeable yoke 22, and magnetic particles 23, which constitute a magnetic circuit. The magnetic particles 23 are held in the gap of the yoke 22 by the magnetic force, forming the actual brush portion of the magnetic brush 2. As for the magnet 21, a sintered rare earth metal magnet is employed.

Figures 2A, 2B, 2C, 2D:
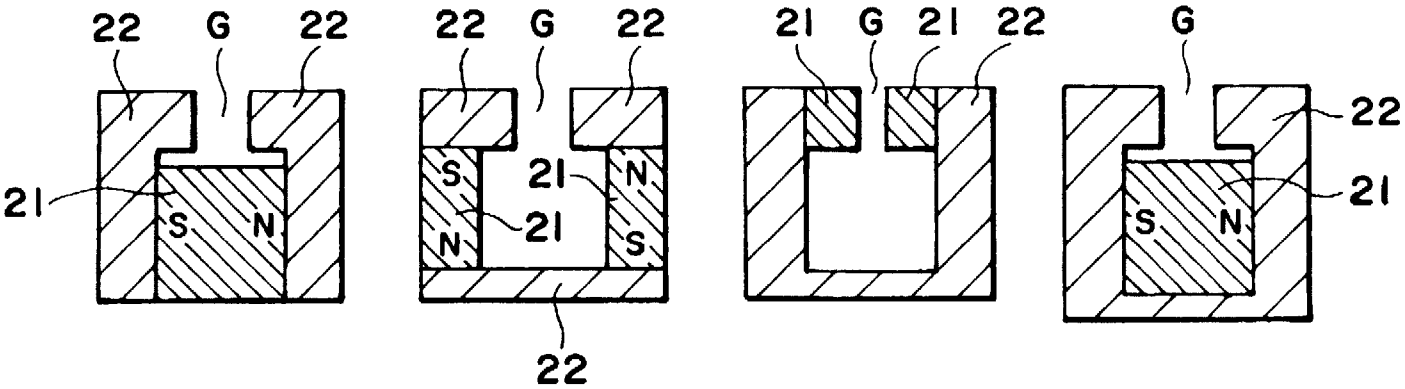
FIGS. 2(*a*)–(*d*) depict sectional views of various forms of a magnetic circuit.
Figure 3A:
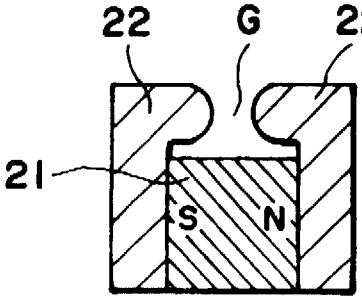
FIGS. 3(*a*)–(*e*) depict sectional views of various forms of the yoke of the magnetic circuit.
Figure 3B:
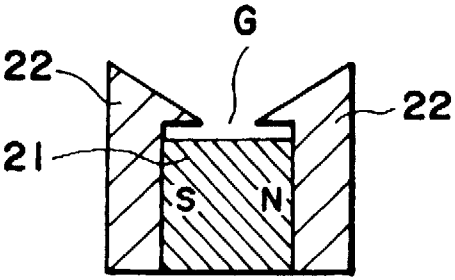
Figure 3C:
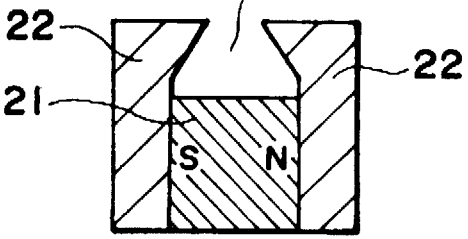
Figure 3D:
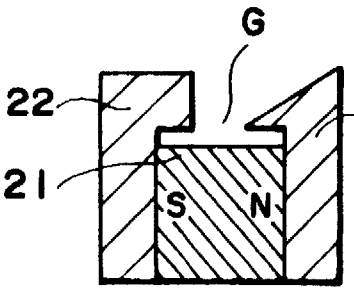
Figure 3E:
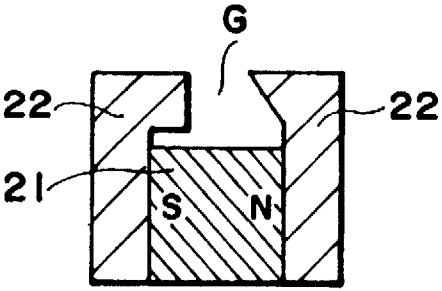

As for the sectional structures of the magnet 21 and the yoke 22 which constitute a portion of the magnetic circuit, the structures such as those illustrated in FIGS. 2(*a*)–2(*d*) are conceivable, and a structural choice may be made in consideration of the magnetic force strength in the gap G, the overall dimension, the overall cost of the magnetic circuit, and the like. As for the magnet 21, a sintered rare earth metal magnet is employed. As for the material for the yoke 22, low carbon content steel such as S10C-S30C is used; the material for the yoke 22 is preferably highly magnetic material.

As for the section of the yoke 22, the configurations illustrated in FIGS. 3(*a*)–3(*e*) may be used. A choice for the yoke section may be made in consideration of the contact pressure between the magnetic brush and the photosensitive member 1, the magnetic force strength in the gap G, and the overall measurement of the magnetic circuit.

The yoke 22 is disposed in such a manner that the minimum distance to the surface of the photosensitive member 1 becomes 0.5–1.0 mm, and a brush of magnetic particles 23 is formed by filling the gap G between the opposing ends of the yoke 22 with the magnetic particles 23. The thus formed magnetic brush is placed in contact with the photosensitive member 1, forming an approximately 5 mm wide charging nip against the photosensitive member 1. Since the yoke 22 is electrically conductive, the minimum distance between the surface of the photosensitive member 1 and the yoke 22 is set to be in a range of 0.5–1.0 mm in order to prevent electrical leakage from the yoke 22 to the photosensitive member 1.

Voltage is applied to the brush of magnetic particles 23 through the yoke 22. The maximum magnetic flux density in the gap G formed between the opposing ends of the yoke 22 is $10{,}000\times10^{-4}$ T (tesla).

As long as the resistance value of the magnetic particles 23 of the magnetic brush 2 as the contact type charging member within a range of $1\times10^5$ −$1\times10^{12}$ Ω when the applied voltage is within a range of 1–1,000 V, charge uniformity can be improved; electrical leakage caused by the surface pinhole of the photosensitive member 1 can be prevented; the magnetic particles can be prevented from adhering to the surface of the photosensitive member 1; and charging capacity can be improved. As a result, a high quality image can be produced.

Figure 4:
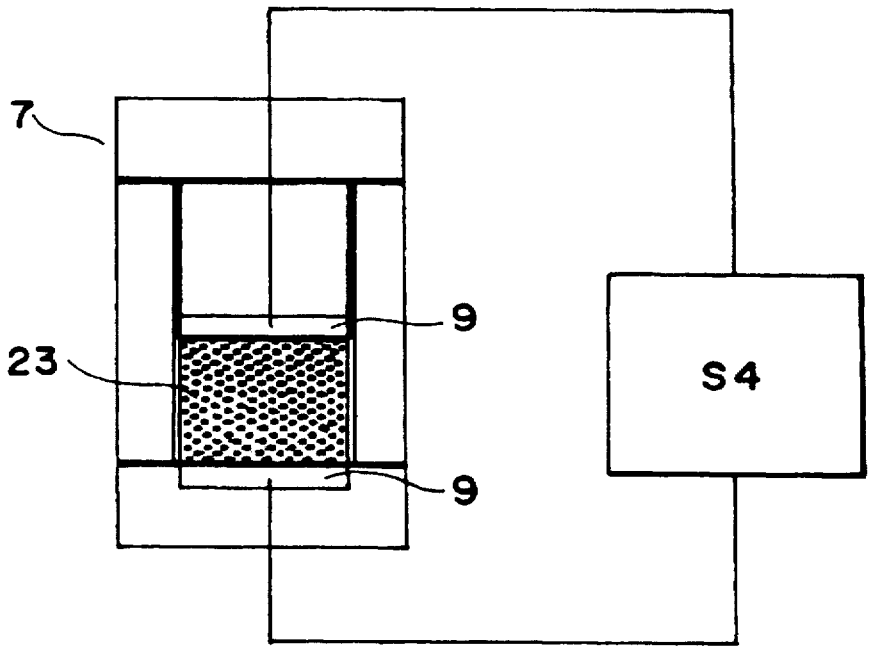
FIG. 4 is a schematic drawing depicting a jig for measuring the resistance of the magnetic particle.

The resistance value of the magnetic particles 23 is measured in a manner illustrated in FIG. 4, wherein two grams of the magnetic particles 23 is packed in a metallic cell 7 (bottom size 228 $m^2$) to which voltage can be applied, and a DC voltage from a power source $S_4$ is applied between electrodes 9 and 9.

It should be noted here that the magnetic particle layer 23 does not need to be in contact with the surface of the photosensitive member 1; a no more than 100 μm wide gap may be present between the two components.

Figure 5A:
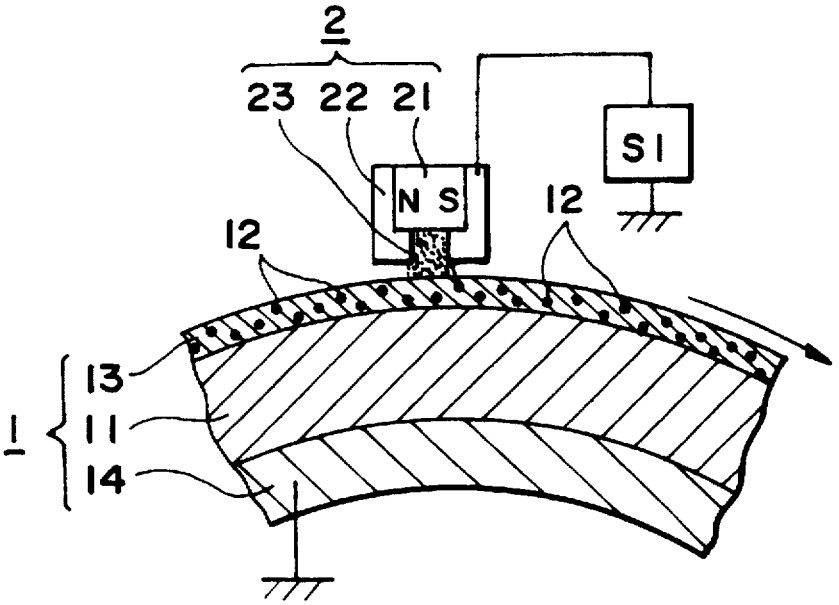
FIGS. 5(*a*)–(*b*) are schematic sectional drawings depicting how the electric charge is injected.
Figure 5B:
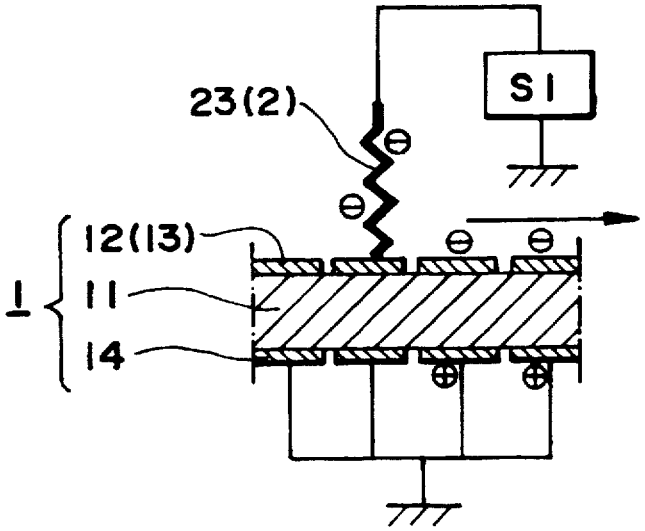
Figure 6:
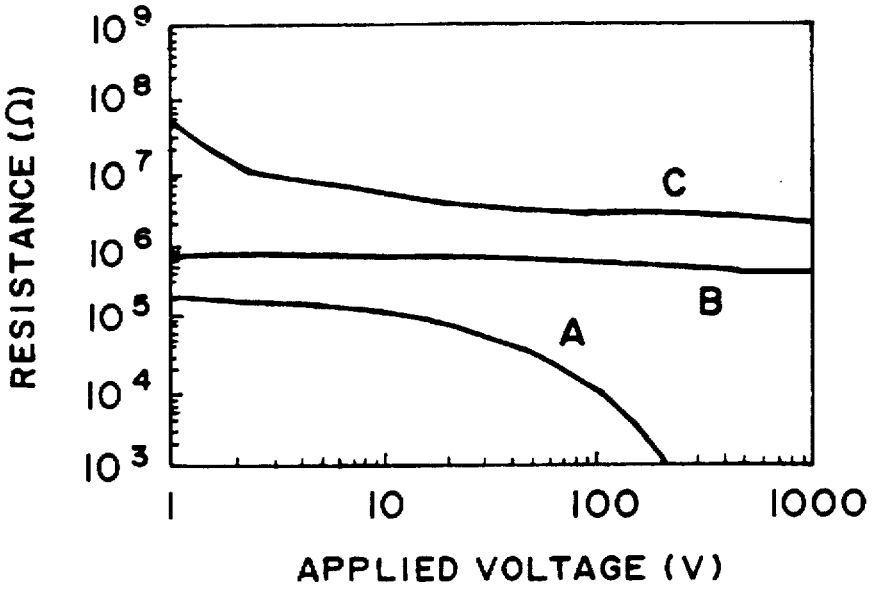
FIG. 6 is a graph showing the resistance values of the various magnetic particles.

<Embodiment 2> (FIGS. 5 and 6)

The contact type charging method described in the preceding first embodiment is essentially based on electric discharge, but in this embodiment, a charging system which directly injects electric charge into the object to be charged will be described.

(A) Photosensitive Member

FIG. 5(*a*) is a schematic drawing depicting the laminar structure of the photosensitive member 1 as the object to be charged, and FIG. 5(*b*) presents an equivalent circuit model for the structure illustrated in FIG. 5(*a*). The photosensitive member in this embodiment is an OPC based photosensitive member, and has a charge injection layer 13 as the surface layer. It has a diameter of 30 mm, and is rotatively driven in the clockwise direction indicated by an arrow mark, at a process speed (peripheral velocity) of 100 mm/sec.

The photosensitive drum 1 comprises five functional layers laminated on the peripheral surface of a drum-shaped aluminum base 14, in the order of the first to fifth layers starting from the bottom.

The first layer constituting an under coating layer is an approximately 20 μm thick electrically conductive layer, which is provided for smoothing the surface imperfection of the drum-shaped aluminum base 14, and also for preventing the occurrence of the moire caused by the reflection of the exposure laser beam.

The second layer is a layer which prevents the injection of positive electric charge. More specifically, it plays a role in preventing the positive electric charge injected from the drum-shaped aluminum base 14 from canceling the negative electric charge given to the photosensitive member surface. It is an approximately 1 μm thick medium resistance layer composed of Amylan resin and methoxylmethyl nylon, and its resistance is adjusted to approximately $10^6$ Ω.

The third layer is a charge generation layer. It is an approximately 0.3 μm thick layer composed of resin material and diazo group pigment dispersed in the resin material, and generates a positive-negative electric charge pair as it is exposed to a laser beam.

The first to third layers described above are not illustrated in the drawing.

The fourth layer is a charge transfer layer 11. It is composed of polycarbonate resin and hydrazone dispersed in the resin, which makes it a P-type semiconductor. Therefore, the negative charge given to the photosensitive surface is not allowed to move through this layer, and only the positive charge generated in the charge generation layer is allowed to be transferred to the photosensitive member surface.

The fifth layer is a charge injection layer 13, which is a coated layer composed of photo-curing acrylic resin and microscopic particles of $SnO_2$, as electrically conductive particles 12, dispersed in the acrylic resin. More specifically, the $SnO_2$ particle has a diameter of approximately 0.03 μm, and is doped with antimony to reduce resistance. It is dispersed in the acrylic resin by a ratio of 70 wt. %, and the mixture is coated to an approximate thickness of 3.0 μm, using a dipping method, to form the electric charge injection layer 13.

Addition of the charge injection layer 13 lowers the resistance of the photosensitive member surface to $1\times10^{11}$ Ω. For comparison, when there is only the charge transfer layer, the resistance of the photosensitive member surface is $1\times10^{15}$ Ω.

A reference numeral 2 designates an electrically conductive magnetic brush as the contact type charging member, which is placed in contact with the photosensitive member 1. To this magnetic brush 2, a DC charge bias of −700 V is applied from the charge bias application power source $S_1$, whereby the peripheral surface of the photosensitive rotary member 1 is uniformly charged to approximately −680 V.

(B) Charging Member 2

The magnetic brush 2 as the contact type charging member comprises a magnet 21, a yoke 22, and magnetic particles 23, and constitutes a magnetic circuit, wherein the magnetic particles are held by magnetic force, in the gap formed between the opposing ends of the yoke 22. As for the magnet 21, a sintered rare earth metal magnet is employed. As for the sectional structures of the portion of the magnetic circuit, the structures such as those illustrated in FIGS. 2(*a*)–2(*d*) are conceivable, and a structural choice may be made in consideration of the magnetic force strength in the gap G, the overall dimension and cost of the magnetic circuit, and the like. As for the material for the yoke 22, low carbon content steel such as S10C-S30C is used. As for the section of the yoke 22, the configurations illustrated in FIG. 3 are conceivable. A choice may be made in consideration of the contact pressure between the magnetic brush and the photosensitive member 1, the magnetic force strength in the gap G, and the overall measurement of the magnetic circuit. The yoke 22 is disposed in such a manner that the minimum distance to the surface of the photosensitive member 1 becomes 0.5–1.0 mm, and a brush of magnetic particles 23 is formed by filling the gap G formed between the opposing ends of the yoke 22 with the magnetic particles 23. The thus formed magnetic brush is placed in contact with the photosensitive member 1, forming an approximately 5 mm wide charging nip against the photosensitive member 1. Voltage is applied to the brush of magnetic particles 23 through the yoke 22. The maximum magnetic flux density in the gap G formed between the opposing ends of the yoke 22 is $10.000\times10^{-4}$ T (tesla).

(C) Principle of Injection Charge

In this embodiment, electric charge is injected into the photosensitive member surface having a medium level surface resistance, using the contact type charging member 2 having also a medium level resistance. Electric charge is not injected into the traps in the photosensitive member surface material. Instead, the electrically conductive particles 12 of the charge injection layer 13 are given electric charge.

More specifically, referring to the equivalent circuit model illustrated in FIG. 5(*b*), it is possible to theorized that the charge carrier layer 11, the drum-shaped aluminum base 14, and the electrically conductive particles 13 ($SnO_2$) in the charge injection layer 12 constitute microscopic condensers, which are charged by the contact type charging member 2, wherein the charge carrier layer 11 functions as a dielectric material, and the drum-shaped aluminum base 14 and the electrically conductive particles 13 function as the opposing electrode plates.

In this case, each of the electrically conductive particles 12 is electrically independent from the other, constituting a sort of a microscopic float electrode. Macroscopically, the photosensitive member surface seems to be uniformly charged, but microscopically, an innumerable number of electrically conductive charged particles 12 cover the photosensitive surface. In other words, since each of the electrically conductive particles is electrically independent from the other, the photosensitive member surface can retain the electrostatic latent image formed thereon when it is exposed to the laser beam L carrying imaging data. The volumetric resistivity of the charge injection layer 13 is preferably in a range of $1\times10^{10}$ Ω·cm–$1\times10^{14}$ Ω·cm (when 100 V is applied). In measuring the volumetric resistivity of the charge injection layer, a sample of the charge injection layer in the sheet form is made, and the volumetric resistivity of this sample is measured by connecting Resistivity cell 16008A to High Resistance Meter 4329A of Yokogawa-Hewlett-Packard.

(D) Magnetic Particle 23

As for the magnetic particle 23 of the magnetic brush 2 as the contact type charging member, the following materials may be considered:

(1) particles formed by kneading together resin and magnetic powder such as magnetite; carbon or the like may be mixed in to adjust resistance;

(2) particles formed by sintering magnetite or ferrite; they may be reduced or oxidized to adjust resistance;

(3) particles produced by coating the above magnetic particles with resistance adjusted coating material (phenol resin in which carbon is dispersed), or by plating the above magnetic particles with metal such as nickel, in order to adjust the resistance thereof to a proper resistance value.

When the resistance value of the magnetic particle 23 is too large, electric charge cannot be uniformly injected into the photosensitive member 1 causing microscopic charge imperfection which results in a foggy image.

When the resistance value of the magnetic particle 23 is too small, electric current converges to pinholes, causing the charge voltage to drop. As a result, the photosensitive member surface cannot be charged. In such a case, charge failure manifests in a pattern matching the charge nip.

Normally, the resistance value of the particle is measured at one or two points while applying a low voltage of 1 V to 100 V. Since the resistance value of the magnetic particle 23 is dependent upon voltage as shown by the graph given in FIG. 6, a problem occurs. That is, it has been known that whether pinhole leak occurs or not is determined by the resistance generated when a high voltage is applied, and whether charge failure occurs or not is determined by the resistance of the magnetic particle 23 generated when a low voltage is applied. Therefore, it is preferable that the resistance value of the magnetic particle 23 is in a predetermined range when the applied voltage is within a range of 1–1,000 V.

For example, in the case of Graph A in FIG. 6, the resistance value is $2\times10^5$ Ω when the applied voltage is 1 V. However, when the applied voltage is 700 V which is the voltage to be applied for charging the photosensitive drum surface, the resistance value becomes $10^4$ Ω or less, allowing the occurrence of pinhole leak. In the case of Graph C, when the applied voltage is the aforementioned 700 V, the resistance value is no less than $10^4$ Ω; therefore, pinhole leak does not occur. However, in this case, the resistance value on the low voltage side is no less than $10^7$ Ω, which causes charge failure. In FIG. 6, Graph A represents magnetite; B, ferrite; and C represents oxidized copper-zinc-ferrite B.

Regarding the resistance value difference between ferrite ($MO\cdot Fe_2O_3$) and magnetite ($FeO\cdot Fe_2O_3$), most of the spinel ferrites have high resistance, but in the case of magnetite, electrons can be substantially freely exchanged between $Fe^{2+}$ and $Fe^{3+}$, and therefore, it displays the resistance characteristic represented by Graph A in FIG. 6.

However, in the case of ferrite comprising a non-iron metal (Al, Se, and the like) whose ionization potential is less (28.447 eV for Al, and 24.76 eV for Se) than ionization potential of $Fe^{3+}$ (30.651 eV), electrons can be also freely exchanged between the non-iron metal and $Fe^{3+}$, and therefore, such a ferrite is expected to exhibit the resistance characteristic depicted by Graph A in FIG. 6.

In other words, when the third order ionization potential of the metal, other than iron, in a ferrite is larger than the third order ionization potential of iron, such a ferrite is expected to display the resistance characteristic depicted by Graph B in FIG. 6; the resistance value of such a ferrite is expected to remain in a range of $1\times10^4$ Ω–$1\times10^7$ Ω when the applied voltage is in a range of 1 V–1,000 V. Therefore, such a ferrite is expected to be effective to prevent the pinhole leakage of the photosensitive member.

According to the evaluation made of the images formed by the aforementioned printer employing a magnetic brush comprising copper-zinc-ferrite as the magnetic particles, which displays the resistance characteristic depicted by Graph B in FIG. 6, even when the photosensitive member 1 had a pinhole, a preferable image which did not show any sign of charge failure could be successfully produced, indicating that electrical leakage did not occur.

Choice for the magnetic particles 23 is not limited to the aforementioned copper-zinc ferrite. Even when resin based magnetic particles were employed, as long as the resistance values thereof were within a range of $1\times10^4$ Ω–$1\times10^7$ Ω when the applied voltage was in a range of 1 V–1,000 V, a preferable image could be produced.

Also, choice for ferrite material is not limited to the copper-zinc ferrite. As described above, when a ferrite contains a divalent metal whose third order ionization potential is larger than that of iron, such a ferrite can produce a preferable image since the resistance value of such a ferrite falls within a range of $1\times10^4$ Ω–$1\times10^7$ Ω when the applied voltage is in a range of 1 V–1,000 V.

For example, nickel, manganese, magnesium, and the like, in addition to copper and zinc, may be listed as a candidate for ferrite material, but in consideration of productional stability and cost, the copper-zinc combination is preferable.

Further, the magnetic particle may be subjected to a surface resistance reducing process so that the resistance value thereof falls in a range of $1\times10^4$ Ω–$1\times10^7$ Ω when the applied voltage is in a range of 1 V–1,000 V.

In the preceding first and second embodiments, when the diameter of the magnetic particle is no more than 10 μm, the magnetic particle adheres to the object to be charged, and when the diameter of the magnetic particle is no less than 100 μm, charge uniformity is lost; therefore, the diameter of the magnetic particle is preferably no less than 10 μm and no more than 100 μm.

It is preferable that the diameter of the magnetic particle is expressed in volumetric distribution diameter. The volumetric distribution diameter of the magnetic particle in this embodiment was obtained using a laser refraction type particle size distribution measurement apparatus HEROS (product of Nippon Densi), wherein a range of 0.05 μm–200 μm was logarithmically divided into 32 classes.

In order to reliably retain, without leakage, even the smaller magnetic particles whose diameters are in a range of 10 μm–1,000 μm, it is preferable that the maximum magnetic flux density in the gap of the yoke 22 is in a range of $1{,}000\times10^4$ T–$10{,}000\times10^{-4}$ T.

When the maximum magnetic flux density is set at a level no higher than $1{,}000\times10^{-4}$ T, the magnetic particles cannot be reliably held to form a magnetic brush, and are liable to be adhered to the photosensitive member. When the maximum magnetic flux density is set at a level no lower than $10{,}000\times10^{-4}$ T, the magnetic particles displays a characteristic like a rigid object; therefore, the photosensitive is liable to be shaved, and/or the condition of the contact between the photosensitive member and the magnetic particle layer is liable to deteriorate.

According to the first and second embodiments, the above described structures can prevent the electrical leakage caused by the pinhole of the photosensitive member surface, can prevent the adhesion of the magnetic particles to the photosensitive member, and can improve charging capacity; therefore, a high quality image can be produced.

Next, another example of the charging member usable with the image forming apparatus illustrated in FIG. 1 or the charging apparatus illustrated in FIG. 5 will be described.

Figure 7:
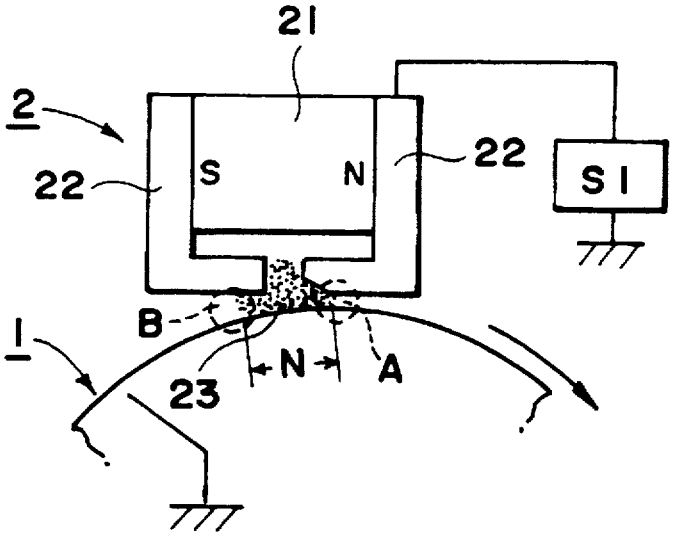
FIG. 7 is a schematic drawing of the structure of the apparatus in the third embodiment of the present invention.

<Embodiment 3> (FIG. 7)

This embodiment is characterized in that the magnetic flux density at the most downstream side point A of the nip N formed by the photosensitive member and the actual brush portion of the magnetic brush 2 as the charging member, which is formed of the magnetic particles, is increased by reducing the distance between the charging member 2 and the photosensitive member 1.

According to experiments, even when the magnetic particles on the upstream side of the nip N are temporarily transferred onto the photosensitive member surface, they are not allowed to permanently transfer to the photosensitive member 1 side since the magnetic flux density at the most downstream side point A is large.

Figure 8:
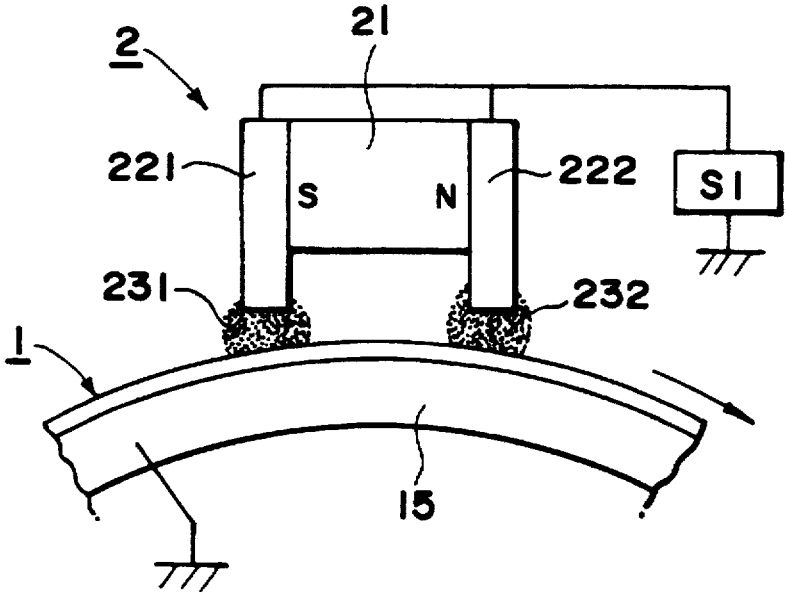
FIG. 8 is a schematic drawing of the structure of the apparatus in the fourth embodiment of the present invention.

<Embodiment 4> (FIG. 8)

This embodiment is characterized in that the bottommost layer of the photosensitive member 1 as the object to be charged is constituted of a base plate 15 composed of highly magnetism permeable material, and the magnetic circuit 21 is constituted of a magnet 21, an upstream side yoke 221, a downstream side yoke 222, magnetic particle clusters 231 and 232, and the bottommost layer of the photosensitive member 1, wherein the upstream side magnetic particle cluster 231, and the downstream side magnetic particle cluster 232 are held, as a brush, in two gaps formed between the yokes 221 and 222, and the photosensitive member 1, respectively. As for the magnetic particles, they are the same as those employed in the preceding embodiments.

In the case of this structure, the upstream side magnetic brush 231 preliminarily charge the photosensitive member surface, and also plays the role of a cleaner for removing the microscopic particles, having slipped by the cleaning blade 6*a* of the cleaning apparatus 6 (FIG. 1), from the surface of the photosensitive member 1. Therefore, the photosensitive member can be reliably charged.

Figure 9A:
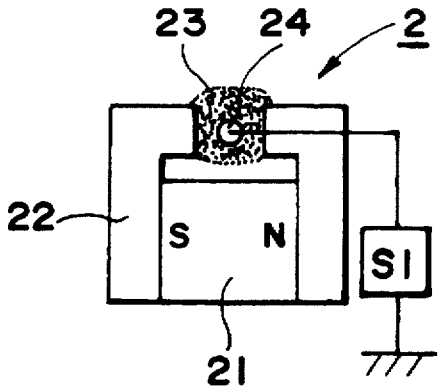
FIGS. 9(*a*)–(*b*) are schematic drawings of the structure of the apparatus (1) in the fifth embodiment of the present invention.
Figure 9B:
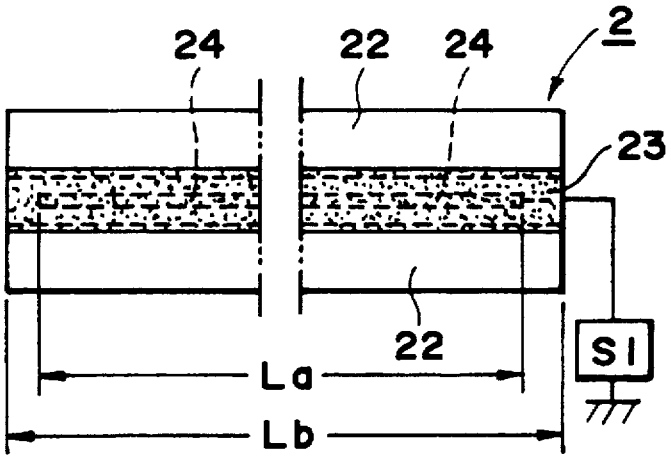
Figure 10A:
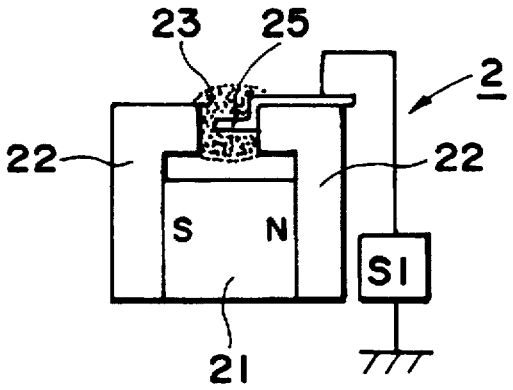
FIGS. 10(*a*)–(*b*) are schematic drawings of the structure of the apparatus (2) in the fifth embodiment of the present invention.
Figure 10B:
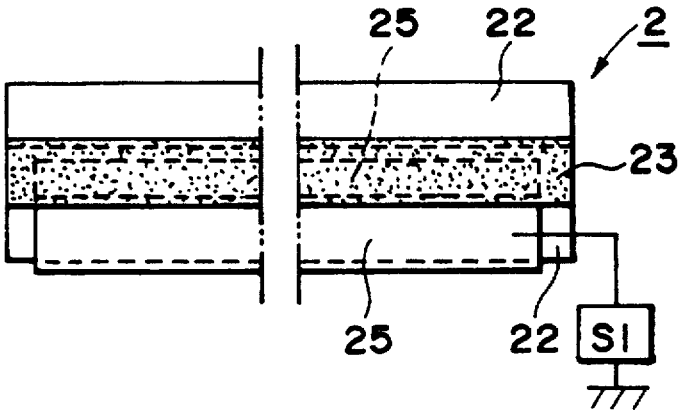
Figure 11:
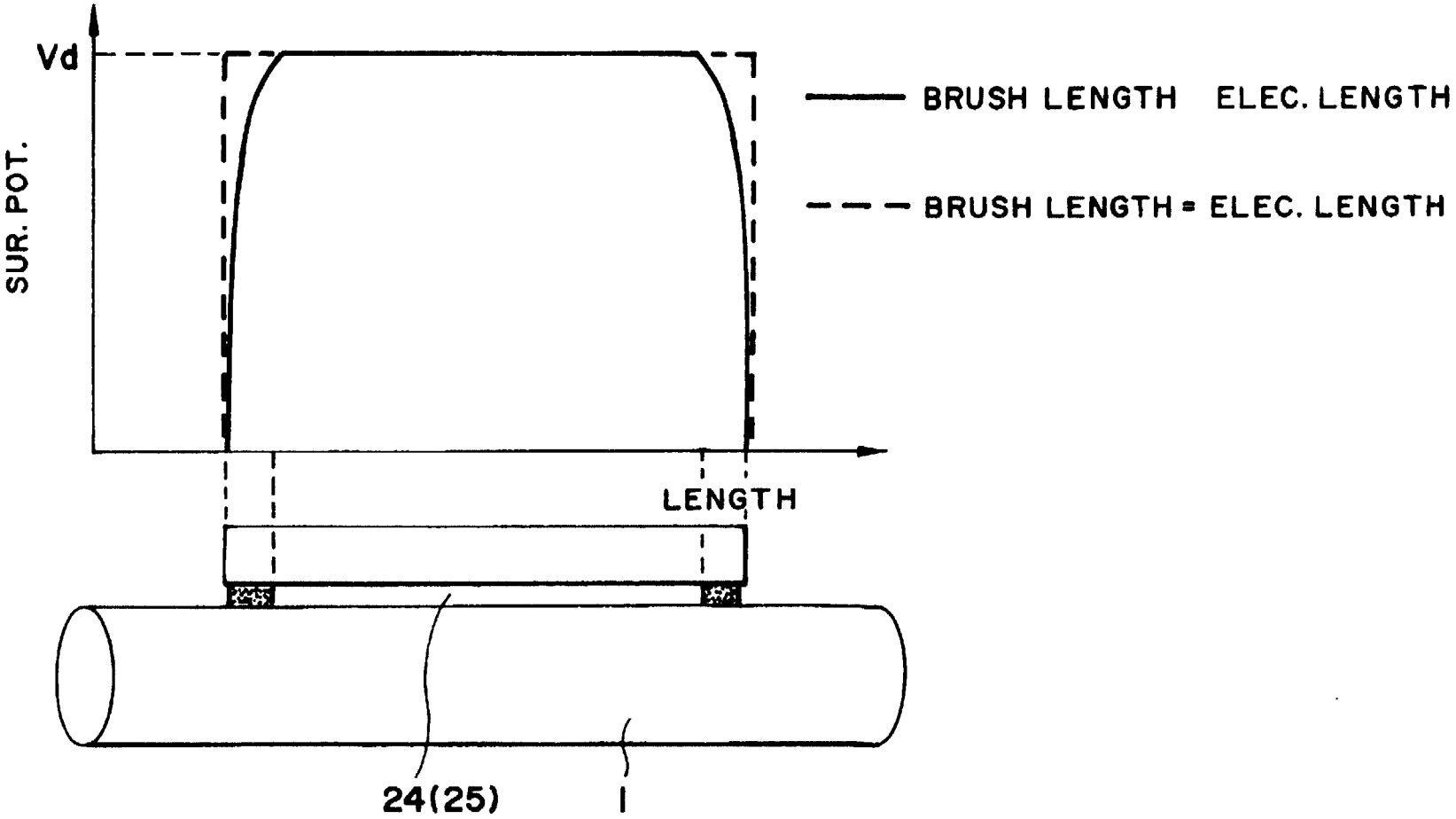
FIG. 11 is a graph showing the surface potential level in the longitudinal direction of the photosensitive member.

<Embodiment 5> (FIGS. 9–11)

This embodiment is characterized in that a wire electrode 24 (FIGS. 9(*a*) and 9(*b*)), or a mesh electrode 25 (FIGS. 10(*a*) and 10(*b*)), for applying voltage to the brush composed of the magnetic particles 23, is disposed in the gap of the yoke 22, and the length $L_a$ of the electrode 24 or 25 in the longitudinal direction of the charging member is rendered shorter than the length $L_b$ of the brush composed of the magnetic particles 23, wherein the electrode in the gap is covered with the magnetic particles 23.

According to experiments, a structure in which the distance between the photosensitive member 1 surface and the electrodes for applying voltage to the brush composed of the magnetic particles 23 is as small as possible without preventing the movement of the magnetic particle is superior in charging performance, and therefore, is most suitable. Further, the magnetic particles located at the tip of the magnetic brush transfer to the photosensitive member surface due to the fluctuation of the surface potential of the photosensitive member, but when the length $L_a$ of the electrodes 24 or 25 in the longitudinal direction of the charging member is rendered shorter than the brush composed of the magnetic particles 23, and also, the electrode is covered with the magnetic particles, the inclination of the surface potential fluctuation becomes gentler as shown in FIG. 11, and therefore, the magnetic particles can be prevented from transferring to the photosensitive member surface.

Figure 12:
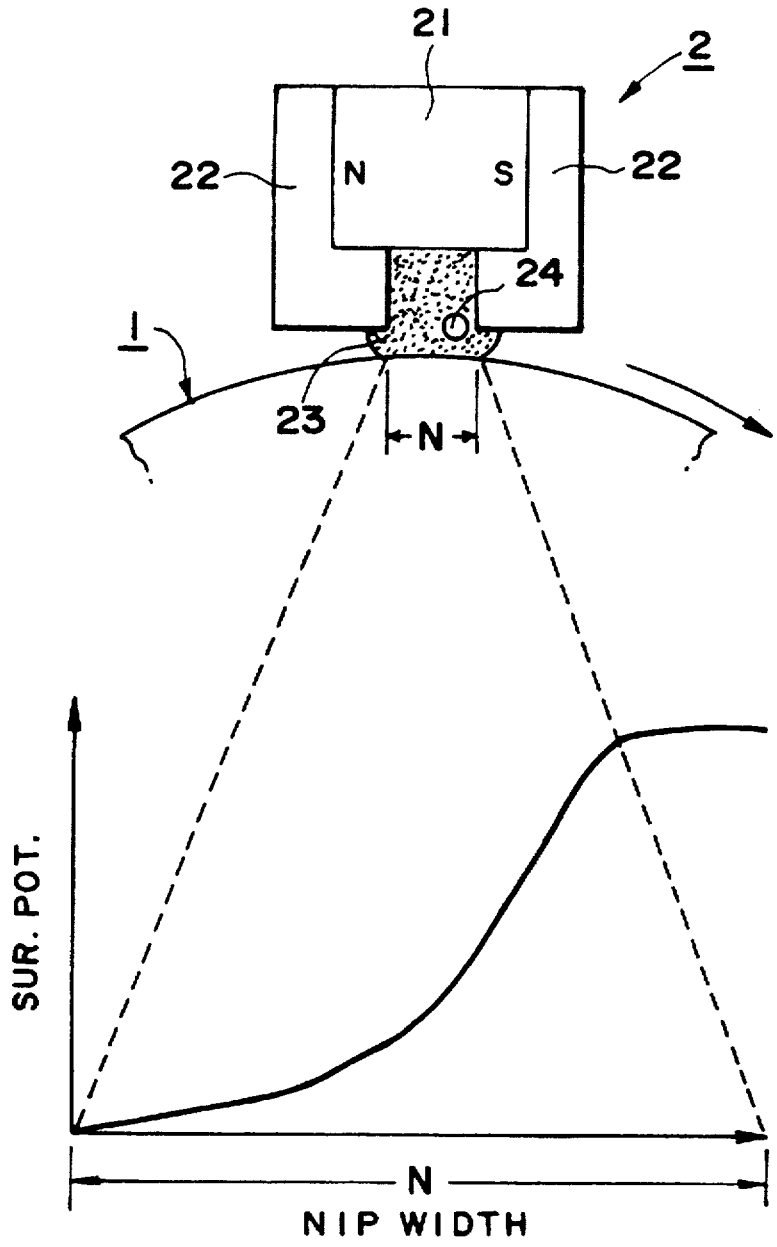
FIG. 12 presents a graph showing the surface potential level of the photosensitive member area in the nip, in conjunction with the schematic drawing of the structure of the apparatus in the sixth embodiment of the present invention.

<Embodiment 6> (FIG. 12)

This embodiment is characterized in that an electrode such as the wire electrode 24 for applying voltage to the brush composed of the magnetic particles 23 is disposed on the downstream side of the gap of the yoke 22 relative to the rotation direction of the photosensitive member.

According to experiments, the condition for preventing the magnetic particles 23 from transferring to the photosensitive member surface is such that the surface potential of the photosensitive member area within the nip N formed by the photosensitive member surface and the brush displays the characteristic depicted by FIG. 12. In the case of the structure depicted in FIG. 12, voltage application from the downstream side relative to the rotational direction of the photosensitive drum prevents the magnetic particles from transferring to the photosensitive member surface, and therefore, this structure is desirable.

Figure 13A:
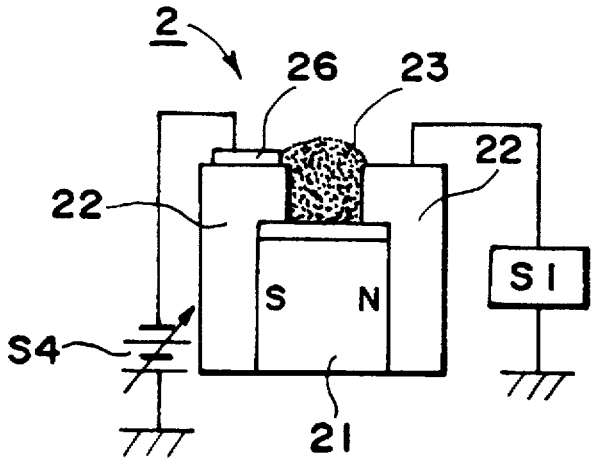
FIGS. 13(*a*)–(*b*) are schematic drawings of the structure of the apparatus in the seventh embodiment of the present invention.
Figure 13B:
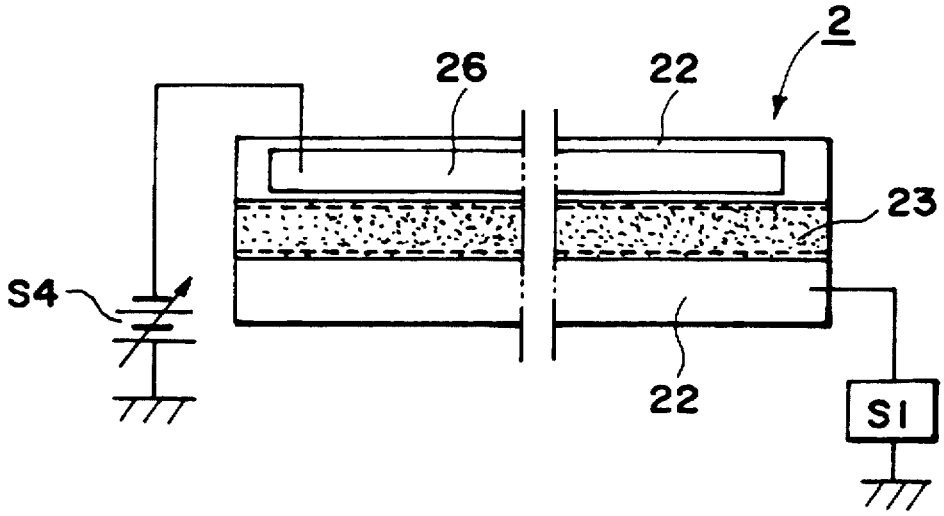
Figure 14:
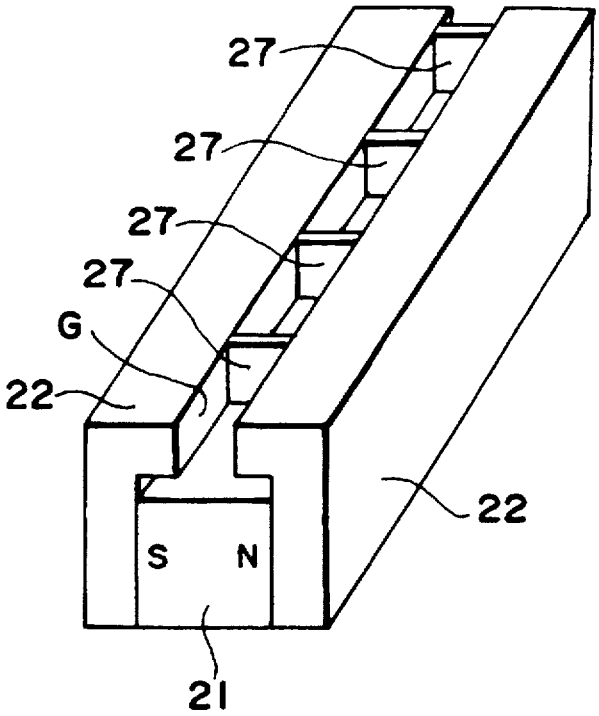
FIG. 14 is a schematic drawing of the structure of the apparatus in the eighth embodiment of the present invention.

<Embodiment 7> (FIGS. 13(*a*) and 13(*b*))

This embodiment is characterized in that the magnetic circuit for holding the brush composed of the magnetic particles 23 is provided with a heating means. The provision of a temperature control heater 26 as the heating means adjacent to the gap prevents moisture from adhering to the surface of the magnetic particle 23, in a high humidity environment, rendering the charging process more reliable. An alphanumeric reference $S_4$ designates a voltage application power source for the temperature control heater 26.

Figure 15:
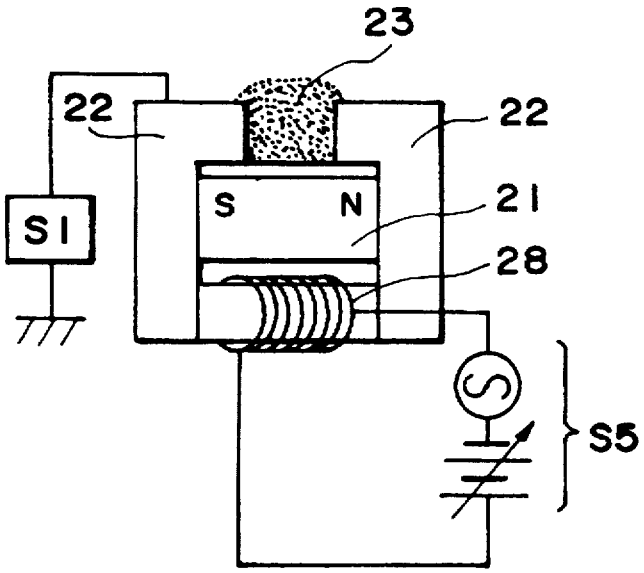
FIG. 15 is a schematic drawing of the structure of the apparatus in the ninth embodiment of the present invention.

<Embodiment 8> (FIG. 15)

This embodiment is characterized in that the gap is provided with nonmagnetic partitioning plates 27, which are perpendicular to the longitudinal direction of the gap of the yoke 22 holding the brush composed of the magnetic particles 23, and hold predetermined intervals. The presence of the partitioning plates 27 prevents the magnetic particles from converging to a particular location when the charging apparatus is dropped or caused to vibrate while it is transported; therefore, the photosensitive member can be reliably charged.

<Embodiment 9> (FIG. 15)

This embodiment is characterized in that an electromagnet 28 is included in the magnetic circuit for holding the brush composed of the magnetic particles 23, wherein the electromagnet 28 is disposed in parallel to the permanent magnet 21. An alphanumeric reference $S_4$ designates the voltage application power source for the electromagnet 28.

The provision of the electromagnet 28 in parallel to the magnet 21 gives following three effects:

(1) Time or temperature induced attenuation of magnetism, which is one of the characteristics of the magnetism of the permanent magnet 21, is compensated with the addition of the electromagnet 28 to stabilize the magnetism of the magnetic brush; therefore the magnetic particles 23 can be reliably held.

(2) The magnetic field of the permanent magnet 21 can be canceled by causing the electromagnet 28 to generate a magnetic field opposing the magnetic field of the magnet 21, so that the magnetic particles 23 are released from the hold of the magnetic force of the magnet 21, making it easier to exchange the brush.

(3) When an injection charge system is employed, an oscillating magnetic field can be generated by applying an oscillating voltage to the electromagnet 28, so that the magnetic particles 23 can be vibrated and stirred to reliably charge the photosensitive member.

While the invention has been described with reference to the structures disclosed herein, it is not confined to the details set forth, and this application is intended to cover such modifications or changes as may come within the purposes of the improvements or the scope of the following claims.

What is claimed is:

1. A charging apparatus comprising;

a charging member contactable or proximatable to a member to be charged, said charging member being capable of being supplied with a voltage;

wherein said charging member comprises a magnetic particle layer, and a magnetic force generating means with a gap for generating magnetic force in the magnetic particles, said magnetic particle layer and magnetic force generating means forming a magnetic circuit; and wherein the magnetic particles have a particle size of no less than 10 μm and no more than 100 μm, and the maximum magnetic flux density in the gap ranges $1{,}000\times10^{-4}$ T–$10{,}000\times10^{-4}$ T.

2. The charging apparatus according to claim 1, wherein said magnetic force generating means comprises a magnet, and a yoke having portions opposed to each other across the gap.

3. The charging apparatus according to claim 1, wherein the resistance of said magnetic particles is in a range of $1\times10^5\ \Omega$–$1\times10^{12}\ \Omega$ when a voltage ranging from 1 V to 1,000 V is applied.

4. The charging apparatus according to claim 1, wherein the member to be charged has an electric charge injection layer surface layer;

said magnetic particle layer is in contact with said charge injection layer;

charge is injected into said charge injection layer through the contact between said magnetic particle layer and charge injection layer; and said magnetic particles have a resistance of $1\times10^4\ \Omega$–$1\times10^7\ \Omega$.

5. The charging apparatus according to claim 1, wherein the magnetic flux density of the contact portion between said magnetic particle layer and the member to be charged, at the most downstream position, with respect to the moving direction of the member to be charged, is larger than the magnetic flux density at the most upstream position.

6. The charging apparatus according to claim 1, wherein the member to be charged comprises a high magnetic permeability base member, and the magnetic force generating means comprises a magnet and a yoke, wherein the magnetic circuit is constituted by said magnet, yoke, and base member; and two gaps are provided at positions between where said yoke in opposed to the member to be charged.

7. The charging apparatus according to claim 1, further comprising an electrode for applying a voltage to said charging member, wherein a length of said electrode in the longitudinal direction of said charging member is shorter than a length of said magnetic particle layer;

and said electrode is covered with said magnetic particles across the entire length in the longitudinal direction of said charging member.

8. The charging apparatus according to claim 1, wherein said charging member comprises an electrode to which voltage is applied, and said electrode is disposed on the downstream side of the gap with respect to the moving direction of the member to be charged.

9. The charging apparatus according to claim 1, further comprising a heating member disposed adjacent to the gap.

10. The charging charging member according to claim 1, further comprising nonmagnetic partitioning members, which partition the gap in the longitudinal direction of the charging member.

11. The charging apparatus according to claim 1, wherein said charging member comprises an electromagnet included in the magnetic circuit.

12. The charging apparatus according to claim 1, wherein the member to be charged is an image bearing member for bearing an image, and the image bearing member and said apparatus are integrated into a process cartridge removably installable in an image forming apparatus.

* * * * *

UNITED STATES PATENT AND TRADEMARK OFFICE

CERTIFICATE OF CORRECTION

PATENT NO. : 5,799,233

DATED : August 25, 1998

INVENTOR(S): YASUYUKI ISHII ET AL.

It is certified that error appears in the above-identified patent and that said Letters Patent is hereby corrected as shown below:

ON COVER PAGE AT [56] REFERENCES CITED, PATENT EXAMINER

"Matthews S. Smith" should read --Matthew S. Smith--.

COLUMN 4

Line 38, "is" should be deleted.

COLUMN 10

Line 37, "displays" should read --display--;
Line 38, "photosensitive" should read --photosensitive member--.

COLUMN 11

Line 13, "charge" should read --charges--.

UNITED STATES PATENT AND TRADEMARK OFFICE

CERTIFICATE OF CORRECTION

PATENT NO. : 5,799,233

DATED : August 25, 1998

INVENTOR(S): YASUYUKI ISHII ET AL.

It is certified that error appears in the above-identified patent and that said Letters Patent is hereby corrected as shown below:

COLUMN 13

Line 28, "in" should read --is--.

Signed and Sealed this

Sixth Day of April, 1999

*Attest:*

Q. TODD DICKINSON

*Attesting Officer*

*Acting Commissioner of Patents and Trademarks*